US010702050B1

(12) United States Patent
Hames

(10) Patent No.: US 10,702,050 B1
(45) Date of Patent: Jul. 7, 2020

(54) MULTI-BAG CARRYING DEVICE

(71) Applicant: Lester Duane Hames, Yukon, OK (US)

(72) Inventor: Lester Duane Hames, Yukon, OK (US)

( * ) Notice: Subject to any disclaimer, the term of this patent is extended or adjusted under 35 U.S.C. 154(b) by 0 days.

(21) Appl. No.: 16/574,225

(22) Filed: Sep. 18, 2019

(51) Int. Cl.
*A45F 5/10* (2006.01)

(52) U.S. Cl.
CPC .... *A45F 5/1026* (2013.01); *A45F 2005/1033* (2013.01)

(58) Field of Classification Search
CPC ..... A45F 5/102; A45F 5/1026; A45F 2005/1033; A45F 2005/104; A45F 2005/1053; A45F 2005/1066
USPC ..... 294/142, 143, 159, 165, 170; 224/925
See application file for complete search history.

(56) References Cited

U.S. PATENT DOCUMENTS

| | | | | |
|---|---|---|---|---|
| 3,180,557 | A | 4/1965 | Thulin | |
| 3,912,140 | A | 10/1975 | Franges | |
| 4,030,649 | A | 6/1977 | Potoroka | |
| 4,193,495 | A * | 3/1980 | Keeley | A63B 71/0045 294/143 |
| 4,796,940 | A | 1/1989 | Rimland | |
| 4,946,065 | A | 8/1990 | Goulter et al. | |
| 5,005,891 | A | 4/1991 | Lunsford | |
| 5,257,845 | A | 11/1993 | McConnell | |
| 5,335,788 | A | 8/1994 | Beasley et al. | |
| 5,447,259 | A * | 9/1995 | Erickson | A45F 5/10 220/759 |
| 5,658,029 | A | 8/1997 | Franko | |
| 5,669,504 | A | 9/1997 | Leone et al. | |
| 5,836,634 | A * | 11/1998 | Finkelman | A45F 5/1026 294/159 |
| 6,062,622 | A | 5/2000 | Susman et al. | |
| 6,247,739 | B1 * | 6/2001 | Lyon | A45F 5/1026 294/137 |
| 6,447,037 | B1 | 9/2002 | Crouch | |
| 6,511,114 | B1 * | 1/2003 | Fludd | A45F 5/1026 294/159 |
| 6,651,941 | B1 * | 11/2003 | Kinsel | A45F 5/1026 248/100 |
| D489,618 | S * | 5/2004 | Startek | D9/434 |
| 7,533,916 | B2 * | 5/2009 | Eichenbaum | A45F 5/1026 294/159 |

(Continued)

FOREIGN PATENT DOCUMENTS

| | | | |
|---|---|---|---|
| FR | 2855022 A1 * | 11/2004 | B60R 7/02 |
| GB | 2132882 | 7/1984 | |
| GB | 2298361 | 9/1996 | |

OTHER PUBLICATIONS

Ebay; "Baggier Shopping Bag Carriers w/ Comfort Grip", retrieved Sep. 13, 2019 from https://www.ebay.com.

(Continued)

*Primary Examiner* — Dean J Kramer
(74) *Attorney, Agent, or Firm* — Robert H. Frantz

(57) ABSTRACT

A device for carrying multiple collapsible bags having a horizontal member, such as a beam or bar, with a handle for receiving a user's hand along an upper edge and three or more hooks along the lower edge of the horizontal member, in which each hook has an opening to receive a pair of handles of a collapsible bag, and in which each hook is positioned with its opening in a non-coplanar orientation relative to each other hook.

16 Claims, 3 Drawing Sheets

(56) References Cited

U.S. PATENT DOCUMENTS

| | | | | |
|---|---|---|---|---|
| D765,981 | S * | 9/2016 | Bare | D3/328 |
| 10,244,851 | B1 * | 4/2019 | Petersson | A45F 3/14 |
| 2006/0163894 | A1 | 7/2006 | Mishek et al. | |

OTHER PUBLICATIONS

Ebay; "D Shape Shopping Bag Holder Trip Grip Handle Carrier Lock Grocery Random Color"; retrieved Aug. 14, 2019 from https://www.ebay.com.
Gifting Experts; "Make less trips with the Mighty Handle"; retrieved Aug. 14, 2019 from http://thegiftingexperts.com.
Biz Journals; "KCK's Mighty Handle: From the living room to 4,500 Wal-Mart Stores"; retrieved Aug. 14, 2019 from https://www.bizjournals.com/kansascity.
Walmart; "Mighty Handle More Bags"; retrieved Aug. 14, 2019 from https://www.walmart.com.
Mighty Handle; package back.
New Egg; "Hanzy All-purpose handle grocery bag holder, industrial bucket carrier and more"; retrieved Aug. 14, 2019 from https://www.newegg.com.
Penn Live; photo of carrying multiple bags with one hand; retrieved on Sep. 13, 2019 from https://www.pennlive.com/opinion/2019/09/with-stauffers-ofkissel-hill-banning-plastic-bags-heres-hoping-it-starts-a-trend-nancy-eshelman.html.
Amazon; "Portable silicone shopping bag handle for plastic bags POMA"; retrieved Aug. 14, 2019 from https://www.amazon.com.
Amazon; "Trolley Bags"; retrieved Aug. 14, 2019 from https://www.amazon.com.
Uline; "Plastic shopping bags"; retrieved Sep. 2, 2019 from https://www.uline.com.
Wikipedia; "Plastic shopping bag"; retrieved on Sep. 2, 2019 from https://en.wikipedia.org.

* cited by examiner

MULTI-BAG CARRYING DEVICE

FIELD OF THE INVENTION

The invention generally relates technologies to assist in single-handed carrying of a plurality of collapsible bags.

BACKGROUND OF INVENTION

Many retail stores and shoppers use a variety of well-known collapsible shopping bags. Some stores supply these bags, and some customers bring their own bags. And, some bags are considered disposable, while others are re-usable.

FIGS. 2 and 3 illustrate one well-known type of collapsible shopping bag 201 which is typically constructed of heavy paper or cloth with an essentially rectangular shaped bottom, two sides 202, two ends 203, a pair of handles 205, with an opening at the top of the sides and ends to receive items to be carried in the bag 201. Typically, the ends are provided with creases, scores, seams or fold lines to allow them to be folded inward or outward, thereby allowing the sides to be brought adjacent to each other, rendering the bag into a flat configuration for storage, mass shipments, and distribution. FIG. 2 provides an isometric view of such a bag, and FIG. 3 provides a top-down view of such a bag, both in an open, non-collapsed configuration.

FIGS. 4 and 5 illustrate another well-known type of collapsible shopping bag 201' which is typically fabricated from plastic film, or sometimes from cloth. It has less structural definition that the foldable bag 201 of FIGS. 2 and 3, but it also has two sides 202', two ends 203', a pair of handles 205', with an opening at the top of the sides and ends to receive items to be carried in the bag 201'. Some historical sources credit Sten Gustaf Thulin with the very first creation of such a bag, described in U.S. Pat. No. 3,180,557, in 1962. Improvements continued to such bag designs to enable greater levels of mass production at lower and lower costs, such as the self-opening polyethylene (PE) bag invented by M. Wayne Beasley, et al., described in U.S. Pat. No. 5,335,788 in 1994. This particular design is sometimes referred to as a T-shirt bag, owing to its resemblance to a T-shirt shape when collapsed and flattened.

The proliferation and adoption of both bag types has been widespread due to the low cost, ability to print advertisements on the side, and the lack of space required to store the collapsed bags.

SUMMARY DISCLOSURE OF THE INVENTION

A device for carrying multiple collapsible bags having a horizontal member, such as a beam or bar, with a handle for receiving a user's hand along an upper edge and three or more hooks along the lower edge of the horizontal member, in which each hook has an opening to receive a pair of handles of a collapsible bag, and in which each hook is positioned with its opening in a non-coplanar orientation relative to each other hook. Certain other embodiment options and enhancements are also disclosed.

BRIEF DESCRIPTION OF THE DRAWINGS

The description set forth herein is illustrated by the several drawings, which are not necessarily drawn to mechanical scale.

DETAILED DESCRIPTION OF EMBODIMENT(S) OF THE INVENTION

The inventor of the present invention has recognized a problem in the art not previously recognized or addressed in the arts related to collapsible shopping or carrying bags, both of the disposable and reusable types. When someone needs to carry a plurality of these bags, especially when carrying several in one hand, the handles are brought together and bunched up so that the hand can pass fingers and the thumb through multiple pairs of handles. This, however, causes the bags not to hang straight down from the hand, but instead, they push on each other, competing for the lowest possible position offset (push sideways) by the bags having the greater weight. As a person walks with one or two hands full of multiple bags, this tear-drop shaped cluster of bags often brushes against the person's legs, which then causes them to spin and twist. As the spinning and twisting occurs, further settling of the heaviest bag into the lowest position occurs, and the cords, straps or handles of the bags may begin to pinch on the person's fingers.

Having researched some available options for multi-bag carrying handles, the present inventor found shortcomings with each available device's design. The presently-disclosed device minimizes or eliminates these shortcomings, while remaining inexpensive to produce and comfortable to use.

Figure 2:
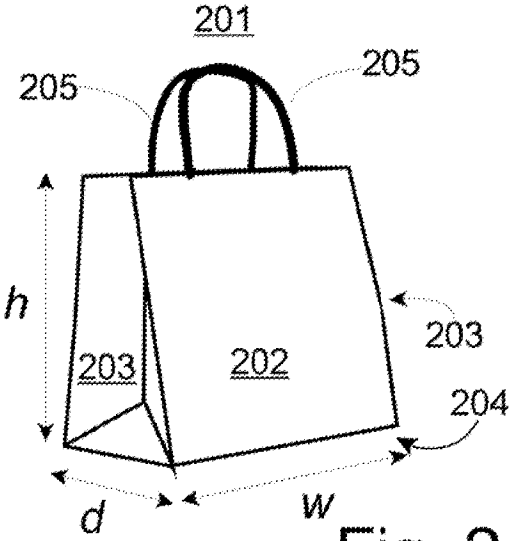
FIG. 2 provides an isometric view of a typical collapsible paper or cloth bag.
Figure 4:
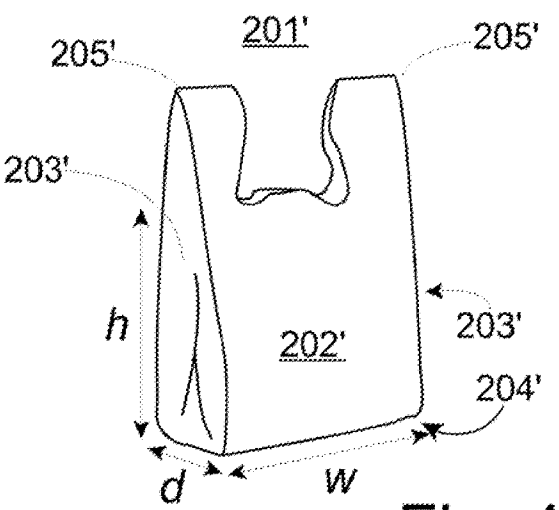
FIG. 4 provides an isometric view of a typical collapsible polyethylene or cloth bag, such as a "T-shirt" bag.

The present inventor noticed that most, if not all, of these collapsible bags are generally horizontally elongated in the shape that they assume when opened and loaded. For example, the type of bag 201 shown in FIGS. 2 and 3 typically has wider w sides 202 than the depth d of the ends 203. Similarly, the type of bag 201' shown in FIGS. 4 and 5 typically has significantly wider w sides 202' than the depth d of the ends 203':

$$w >> d \qquad \text{Eq. 1}$$

Figure 3:
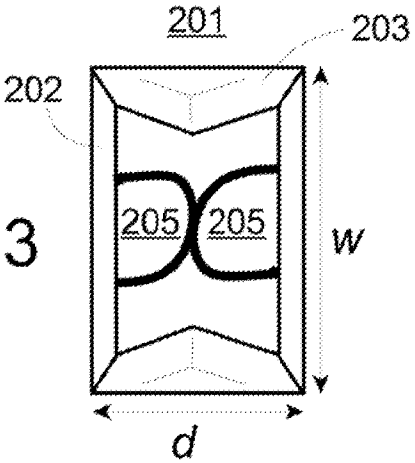
FIG. 3 provides a top-down view of the bag of the type shown in FIG. 2.
Figure 5:
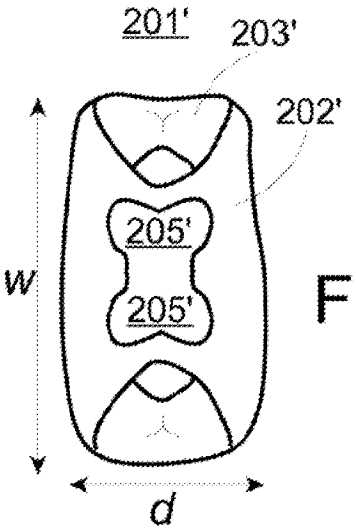
FIG. 5 provides a top-down view of the bag of the type shown in FIG. 4.

This is most evident in the top-down views of FIGS. 3 and 5. The inventor also notice that, even though some bags have handles 205 formed in loops attached to the sides 202 which cause the fingers to pass through the handles in a side-to-side direction, and other bags have handles 205' formed in loops attached to the ends 203' which cause the fingers to pass through the handles in an end-to-end direction, the same twisting and weight-based position conflict occurs in both bag types when multiple pairs of handles are bunched together for carrying (suspension) from a single hand.

Figure 1:
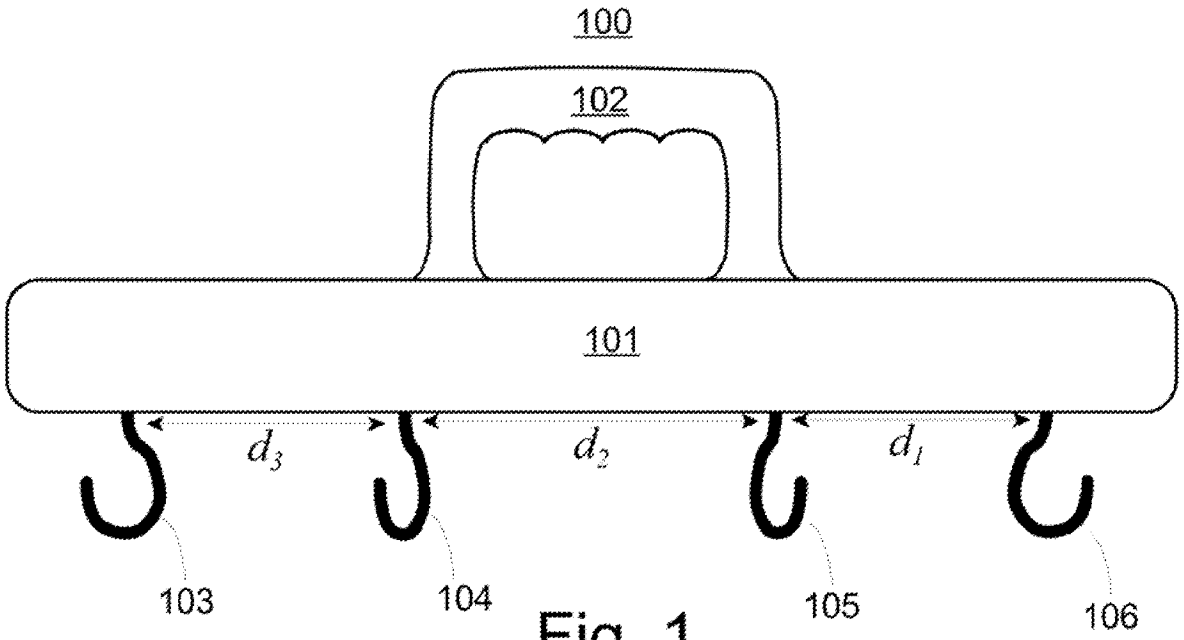
FIG. 1 provides a side view of at least one embodiment of the present invention.

Applicant experimented with designs to solve this problem, which resulted in the configuration shown from a side view in FIG. 1. The multi-bag carrying device 101 has a generally longitudinal horizontal member 101, such as a bar, tub, rod or beam, provided with a handle 102, such as an ergonomic knurled handle, along the upper edge of the horizontal member. Along a lower edge of the horizontal member is provided a plurality (3 or more) of open hooks 103, 104, 105, and 106 spaced distances $d_1$, $d_2$, and $d_3$ apart from each other to allow each bag hanging from each hook to have a certain amount of space from handle-to-handle of the bags. This de-clusters the group of bags to some degree, allowing them to hang more vertically than in a single point of hanging, which reduces positional interference among the bags.

Figure 6:
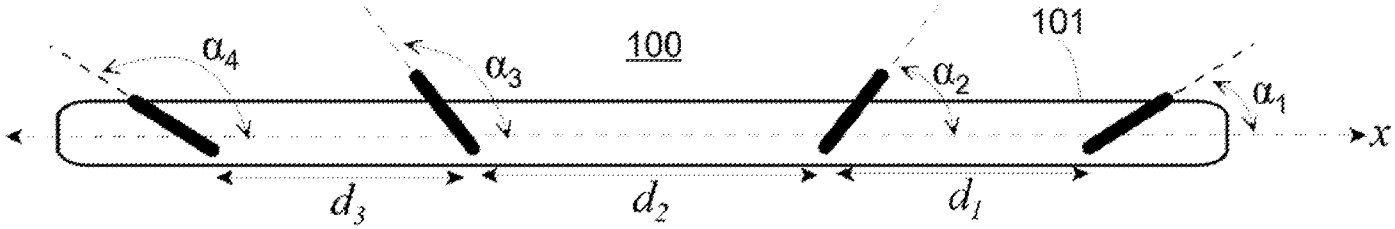
FIG. 6 provides a bottom-up view of the embodiment of FIG. 1.

Further, the hooks 103, 104, 105, and 106 are positioned in a non-planar orientation as shown from a bottom view in FIG. 6. Instead of having two hooks facing opposite directions within the same plane, i.e. one facing forward and the other facing rearward, each hook is positioned to open in a different direction relative to a common plane. Thus, the directions of their openings are non-planar (e.g., not co-planar). In this example, a plane x is referenced passing through the length of the horizontal member 101, and the angles $\alpha_1$, $\alpha_2$, $\alpha_3$, and $\alpha_4$ (alpha 1 through 4) vary from each other:

$$\alpha_1 \neq \alpha_2 \neq \alpha_3 \neq \alpha_4 \qquad \text{Eq. 2}$$

In this manner, the generally elongated or oblong horizontal cross sectional shaped of the loaded bags are rotated with respect to each other, causing them to nestle and settle among each other in a more stable arrangement than when simply bunched together at the tops by the handles.

In one embodiment, the hooks are of the open type, such as cup hooks, the horizontal member is a strip of wood, and the handle is formed of plastic and attached to the horizontal member by fasteners. In other embodiments, one or more of these components can be integral, such as formed together through plastic molding, additive manufacturing or subtractive manufacturing. In still other embodiments, the handle may be provided with a hinge or pivot to the horizontal member to allow the horizontal member to swing or tilt to assume an angle relative to the user's hand and wrist that does not place a twist or moment of force on the user's hand or wrist. In other embodiments, the hooks may be semi-closed, and/or may have optional gates or latches which snap closed to prevent accidental loss of bag handles from the hook (e.g., safety hooks). The disclosed example shows four hooks at four different, non-planar angles relative to each other, but other embodiments may have more hooks than four, or as few as three to achieve some or all of the benefits of the present invention.

Figure 8:
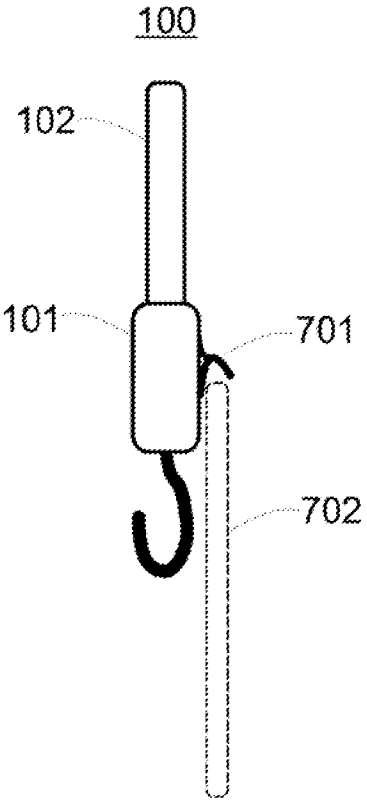
FIG. 8 provides an end-view of the enhanced embodiment show in FIG. 7 as engaged with a side of a shopping cart.
Figure 7:
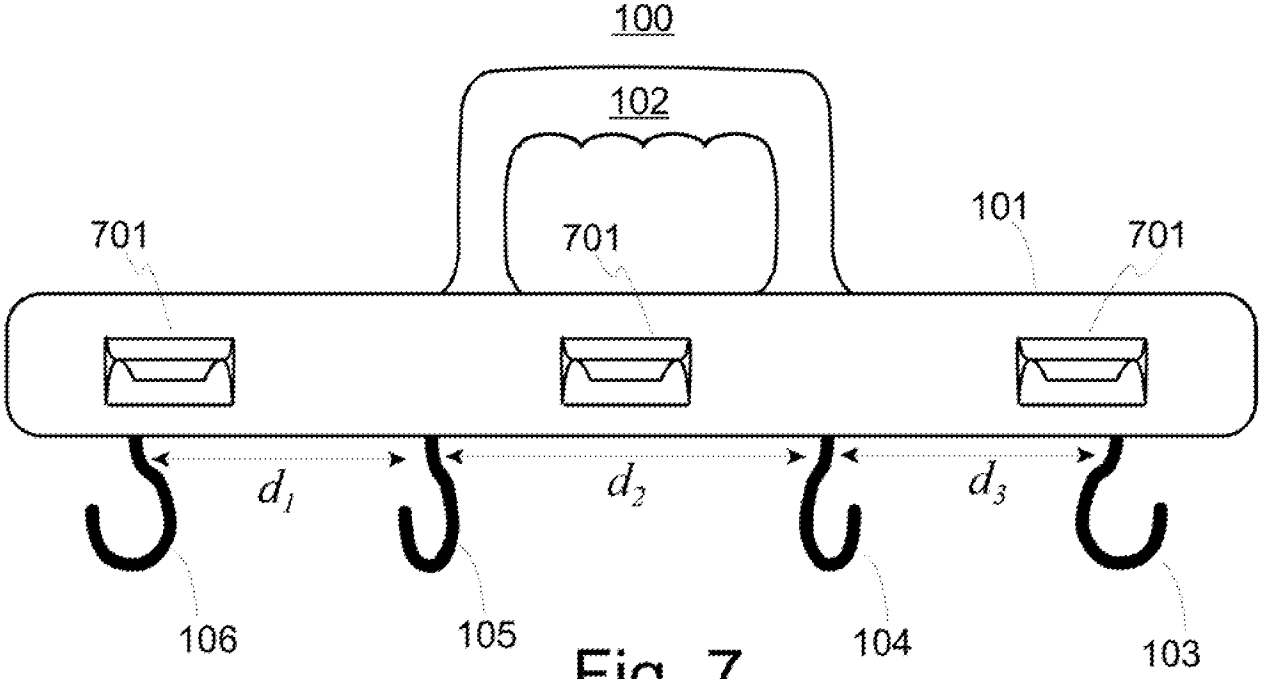
FIG. 7 illustrates an enhanced embodiment including cart hooks.

In yet another enhanced embodiment, one or more cart hanging hooks, clips, ridges, indentations, or recesses 701 are provided along the horizontal member 101, as shown in FIG. 7. These cart hanger(s) can be multiple individual features, or a single elongated hook, clip, ridge, indentation or recess, so long as the size of the downward-facing hanger(s) are suitable sized to receive a top edge of a side of a shopping cart 702 as shown in FIG. 8. Some shopping carts are fabricated from welded rods and heavy gauge wire, while others are fabricated from plastic members, which tend to be wider or thicker than the rods or wire structures. So, the cart hangers may need to be different depths and widths according to the intended type of shopping cart on which the carrying device 100 is to be hung. Hanging the carrying device 100 on the side of a shopping cart provides for easy loading of shopping bags while they are hanging on the hooks 103, 104 . . . 106, and allows for a quick, single-handed move to transfer all of the bags from the shopping cart to a vehicle hatchback or trunk. The latter benefit is especially useful for parents who are juggling getting children situated into car seats while also transferring the shopping bags from the shopping cart to the vehicle.

CONCLUSION

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof, unless specifically stated otherwise.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

It will be readily recognized by those skilled in the art that the foregoing example embodiments do not define the extent or scope of the present invention, but instead are provided as illustrations of how to make and use at least one embodiment of the invention. The following claims define the extent and scope of at least one invention disclosed herein.

What is claimed is:

1. A device for carrying multiple horizontally-elongated bags while walking, each bag having a pair of handles, the device comprising:

a linear horizontal member having an upper edge and a lower edge and having a horizontal length;

a handle for receiving a user's hand attached to the upper edge of the horizontal member, wherein the handle has a horizontal length less than the horizontal length of the linear horizontal member;

three or more hooks attached to the lower edge of the linear horizontal member, whereby each hook has an opening configured to receive a pair of handles of a horizontally-elongated bag, whereby horizontal spaces formed between the three or more hooks are configured to horizontally decluster a plurality of horizontally-elongated loaded bags when hung from the three or more hooks, and whereby each hook is positioned with an angle of each respective opening in a non-coplanar orientation relative to an angle of each opening of each other hook such that all hook openings are angled within 180° or less of each other, thereby positioning the loaded horizontally-elongated bags into a grouped shape conducive to preventing interference with a user's walking leg movement while being carried at an arm's length below a user's shoulder.

2. The multi-bag carrying device as set forth in claim 1 wherein the linear horizontal member and the handle are formed integrally to each other.

3. The multi-bag carrying device as set forth in claim 1 wherein the linear horizontal member and the three or more hooks are formed integrally to each other.

4. The multi-bag carrying device as set forth in claim 1 wherein the linear horizontal member, the handle, and the three or more hooks are formed integrally to each other.

5. The multi-bag carrying device as set forth in claim 1 wherein the handle comprises one or more ergonomic knurls for receiving one or more fingers of a user's hand.

6. The multi-bag carrying device as set forth in claim 1 wherein the linear horizontal member comprises one or more elements selected from the group consisting of a beam, a tube, a rod, and a bar.

7. The multi-bag carrying device as set forth in claim 1 further comprising one or more cart hangers disposed along the horizontal member and configured to receive an upper edge of a shopping cart side.

8. The multi-bag carrying device as set forth in claim 7 wherein the one or more cart hangers comprises one or more features selected from the group consisting of a hook, a groove, a clip, a ridge, an indentation and a recess.

9. A method of manufacture of a device for carrying multiple horizontally-elongated bags while walking, each bag having a pair of handles, the method comprising steps of:

disposing, along an upper edge of a linear horizontal member along, a handle for receiving a user's hand attached, wherein the handle has a horizontal length less than a horizontal length of the linear horizontal member;

disposing, along a lower edge of the linear horizontal member, three or more hooks, whereby each hook has an opening to receive a pair of handles of a horizontally-elongated bag, whereby horizontal spaces formed between the three or more hooks are configured to horizontally decluster a plurality of horizontally-elongated loaded bags when hung from the three or more hooks, and whereby each hook is positioned with an angle of each respective opening in a non-coplanar orientation relative to an angle of each opening of each other hook such that all hook openings are angled within 180° or less of each other, thereby positioning the loaded horizontally-elongated bags into a grouped shape conducive to preventing interference with a user's walking leg movement while being carried at an arm's length below a user's shoulder.

10. The method of manufacture as set forth in claim 9 wherein the linear horizontal member and the handle are formed integrally to each other.

11. The method of manufacture as set forth in claim 9 wherein the linear horizontal member and the three or more hooks are formed integrally to each other.

12. The method of manufacture as set forth in claim 9 wherein the linear horizontal member, the handle, and the three or more hooks are formed integrally to each other.

13. The method of manufacture as set forth in claim 9 wherein the handle comprises one or more ergonomic knurls for receiving one or more fingers of a user's hand.

14. The method of manufacture as set forth in claim 9 wherein the linear horizontal member comprises one or more elements selected from the group consisting of a beam, a tube, a rod, and a bar.

15. The method of manufacture as set forth in claim 9 further comprising disposing one or more cart hangers disposed along the linear horizontal member, wherein the one or more cart hangers are configured to receive an upper edge of a shopping cart side.

16. The method of manufacture as set forth in claim 15 wherein the one or more cart hangers comprises one or more features selected from the group consisting of a hook, a groove, a clip, a ridge, an indentation and a recess.

* * * * *